US005488193A

United States Patent [19]

Mackerer et al.

[11] Patent Number: 5,488,193

[45] Date of Patent: Jan. 30, 1996

[54] PROCESS FOR REDUCING POLYNUCLEAR AROMATIC MUTAGENICITY BY ALKYLATION

[75] Inventors: Carl R. Mackerer, Pennington; Timothy A. Roy, Hopewell, both of N.J.; Gary R. Blackburn, Washington Crossing, Pa.

[73] Assignee: Mobil Oil Corporation, Fairfax, Va.

[21] Appl. No.: 378,308

[22] Filed: Jan. 25, 1995

Related U.S. Application Data

[63] Continuation of Ser. No. 202,720, Feb. 23, 1994, abandoned, which is a continuation of Ser. No. 972,398, Nov. 6, 1992, abandoned.

[51] Int. Cl.[6] ..... C07C 2/66

[52] U.S. Cl. ..... 585/455; 585/456; 585/459; 585/462; 585/465; 585/466; 585/467; 585/468

[58] Field of Search ..... 585/455, 456, 585/459, 462, 465, 466, 467, 468

[56] References Cited

U.S. PATENT DOCUMENTS

| | | | |
|---|---|---|---|
| Re. 28,341 | 2/1975 | Wadlinger et al. | 208/120 |
| 3,308,069 | 3/1967 | Wadlinger et al. | 252/455 |
| 4,140,622 | 2/1979 | Herout et al. | 585/448 |
| 4,321,094 | 3/1982 | Batt et al. | 106/32 |
| 4,368,343 | 1/1983 | Kotlyarevsky et al. | 585/459 |
| 4,429,176 | 1/1984 | Chester et al. | 585/481 |
| 4,499,187 | 2/1985 | Blackburn et al. | 435/34 |
| 4,519,841 | 5/1985 | Moynihan | 106/27 |
| 4,522,929 | 6/1985 | Chester et al. | 502/77 |
| 4,594,146 | 6/1986 | Chester et al. | 208/111 |
| 4,663,492 | 5/1987 | Chester et al. | 585/408 |
| 4,714,794 | 12/1987 | Yoshida et al. | 585/459 |
| 4,954,325 | 9/1990 | Rubin et al. | 423/328 |
| 4,982,037 | 1/1991 | Nakamura et al. | 585/467 |
| 5,015,797 | 5/1991 | Lee et al. | 585/467 |
| 5,030,785 | 7/1991 | Huss, Jr. et al. | 585/467 |
| 5,034,119 | 7/1991 | Blackburn et al. | 208/309 |
| 5,053,573 | 10/1991 | Jorgensen et al. | 585/467 |
| 5,082,983 | 1/1992 | Breckenridge et al. | 585/467 |
| 5,082,990 | 1/1992 | Hsieh et al. | 585/467 |
| 5,258,565 | 11/1993 | Kresge et al. | 585/467 |
| 5,258,566 | 11/1993 | Kresge et al. | 585/467 |

FOREIGN PATENT DOCUMENTS

| | | | |
|---|---|---|---|
| 2084177 | 4/1982 | United Kingdom | 585/459 |

OTHER PUBLICATIONS

Carcinogenesis, vol. 10, Huberman & Barr, Raven Press, New York, 1985, pp. 449–463.

Acc. Chem. Res., 21, Harvey & Geacintov, 1988, pp. 66–73.

J. Org. Chem., 47, Pataki et al., 1982, pp. 1133–1136.

*Primary Examiner*—Asok Pal

*Attorney, Agent, or Firm*—Alexander J. McKillop; Malcolm D. Keen

[57] ABSTRACT

A process for reducing the mutagenicity of a polynuclear aromatic containing material containing from three to seven fused aromatic rings, especially a hydrocarbon refinery stream. The process reduces the initial mutagenicity index to a lower value by alkylating the compound with an alkylating agent which introduces an alkyl substituent having from three to five carbon atoms into the aromatic compound in the presence of an acid catalyst under alkylation conditions.

8 Claims, No Drawings

PROCESS FOR REDUCING POLYNUCLEAR AROMATIC MUTAGENICITY BY ALKYLATION

This is a continuation of Ser. No. 08/202,720, filed Feb. 23, 1994, now abandoned, which is a continuation of Ser. No. 07/972,398, filed Nov. 6, 1992, now abandoned.

FIELD OF THE INVENTION

The present invention relates to useful hydrocarbon-based products, and to a process for their preparation. More particularly, this invention is directed to hydrocarbon-based products of reduced mutagenicity, and to a process for reducing the polynuclear aromatic mutagenicity of such products.

BACKGROUND OF THE INVENTION

In the refining of crude oil, conventional processing to recover fractions suitable for upgrading in various refinery processing operations begins with distillation, wherein the crude oil is first distilled in an atmospheric distillation tower, with residual material from the bottom of the distillation tower often further separated in a vacuum distillation tower. In this operation, gas and gasoline generally are recovered as overhead products of the atmospheric distillation tower, heavy naphtha, kerosene and gas oils are taken off as distillate side streams and the residual material is recovered from the bottom of the tower as reduced crude. The reduced crude is often charged to a vacuum distillation tower. The vacuum distillation step in lube refining provides one or more raw lube stocks within the boiling range of about 550° F. to 1050° F., as well as the vacuum residuum byproduct.

In lube refining, following vacuum distillation, each raw stock is extracted with a solvent, e.g. furfural, phenol or chlorex, which is selective for aromatic hydrocarbons, removing undesirable components. The vacuum residuum usually requires an additional step, typically propane deasphalting, to remove asphaltic material prior to solvent extraction. The products produced for further processing into base stocks are known as raffinates. The raffinate from solvent refining is thereafter dewaxed and then processed into finished lube base stocks.

The solvent extraction step separates hydrocarbon mixtures into two phases; the previously described raffinate phase which contains substances of relatively high hydrogen to carbon ratio, often called paraffinic type materials, and an extract phase which contains substances of relatively low hydrogen to carbon ratio often called aromatic type materials. Furfural is typical of a suitable solvent extraction agent. Its characteristics permit use with both highly aromatic and highly paraffinic oils of wide boiling range. Diesel fuels and light and heavy lubricating stocks are often refined with furfural.

While the furfural solvent extraction unit raffinate goes on to further processing, the extract from the operation often finds utility in a broad range of industrial applications. Applications for these aromatic extracts often vary according to the particular properties of the extracts, these properties largely a function of the feedstock used and unit conditions. For example, as described in "A New Look at Oils in Rubber" by H. F. Weindel and R. R. Terc, *Rubber World*, December, 1977, these extracts often find further utility as low and high viscosity aromatic extender oils for rubber processing. Bright stock extracts (BSE's), obtained by solvent-refining deasphalted vacuum resids during the production of bright stocks, are also useful in rubber processing and find utility as ink oils as well. Like the lighter aromatic extracts, BSE's possess excellent solvent characteristics which lend themselves to great potential utility.

Besides having utility as a feedstock to the solvent extraction unit, the raffinate stream of the deasphalting unit can find further utility as a specialty oil. Depending on its characteristics, this stream, also known as deasphalted oil (DAO), can find utility as an extender oil for rubber processing, as an ink oil, etc.

In recent years, concerns have arisen regarding the potential hazards associated with the use of various lubricating oils, middle distillates, aromatic oils and other hydrocarbon-based products containing polynuclear aromatics (PNA's), since certain of these compounds have been shown to cause cancer in humans and laboratory animals following exposure thereto. Previous studies of the higher boiling fractions recovered from vacuum distillation and processed to formulate engine oils and other lubricants have established a fairly consistent pattern of the types of petroleum-derived materials which cause tumors in laboratory animals. Extensively treated oils, such as those treated by solvent refining and severe hydroprocessing are known to only have trace amounts of PNA's. As such, these materials are generally not tumorigenic; while materials having high PNA levels, especially those compounds having three or more rings, are.

Concerning the use of various aromatic oils, DAO's and BSE's, U.S. Pat. No. 4,321,094, notes at col. 2, lines 9–14, that "many printing ink oils still contain proportions of aromatic hydrocarbons which either are proven to be carcinogenic, such as benzene, or are believed to be carcinogenic, such as toluene and polycyclic compounds. Clearly elimination of these from an ink would be desirable for health reasons." As a result of these concerns, many refiners are no longer willing to supply DAO's or aromatic extracts, including BSE's, for these speciality applications. Those refiners that continue to market these products must provide labels outlining the potential risks associated with the use of these products. This has led to the development and selection of alternate materials for applications previously fulfilled by aromatic oils, as evidenced by U.S. Pat. Nos. 4,321,094 and 4,519,841. The use of these alternative solvents often carries with it the penalty of higher cost and inferior finished product quality.

Further, as disclosed in U.S. Pat. No. 4,321,094, an inventor of which is also a co-inventor of the present invention, certain middle distillates used as specialty oils possess the potential for significant human exposure due to the nature of their industrial applications. While such straight-run middle distillates boil below 700° F. and typically contain only small levels of PNA compounds, they would not be expected to cause tumors in tests conducted on laboratory animals. However, experiments using laboratory animals have shown this to not be the case.

To determine the relative mutagenic activity of a petroleum-based product, a reliable test method for assaying such activity in complex hydrocarbon mixtures is required. A highly reproducible method showing strong correlation with the carcinogenic activity index of hydrocarbon mixtures is disclosed in U.S. Pat. No. 4,499,187, which is incorporated by reference in its entirety. From the testing of hydrocarbon samples as disclosed in U.S. Patent No. 4,499,187, a property of the sample, known as its Mutagenicity Index (MI) is determined. Hydrocarbon mixtures exhibiting MI's less than or equal to 1.0 are known to be non-carcinogenic, while samples exhibiting MI's equal to about 0.0 are known to be completely free of mutagenic activity.

U.S. Pat. No. 5,034,119, an co-inventor of which is also a co-inventor of the present invention, discloses a process for producing non-carcinogenic bright stock extracts and deasphalted oils from reduced hydrocarbon feedstocks. Such non-carcinogenic products are produced by establishing a functional relationship between mutagenicity index and a physical property correlative of hydrocarbon type for the bright stock extract or deasphalted oil and determining a critical physical property level which, when achieved, results in a product having a mutagenicity index of less than about 1.0. Process conditions are established so that a product stream achieving the desired physical property level can be produced. Non-carcinogenic bright stock extracts or deasphalted oils are then processed utilizing the conditions so established.

Despite these advances in the art, a need exists for a process for reducing the mutagenicity of a broad range of petroleum-based products.

SUMMARY OF THE INVENTION

In accordance with the present invention, a process for reducing the mutagenicity of a polynuclear aromatic containing material is provided. The process includes the step of contacting the polynuclear aromatic containing material having an initial mutagenicity index value in the presence of an alkylating agent with an acid catalyst under alkylation conditions sufficient to reduce the mutagenicity of the polynuclear aromatic containing material to a level less than the initial mutagenicity index value.

Also provided is a process for reducing the mutagenicity of a hydrocarbonaceous refinery stream containing polynuclear aromatic compounds having three to seven rings. The process includes the step of contacting the polynuclear aromatic containing refinery stream in the presence of an alkylating agent with an acid catalyst under alkylation conditions sufficient to reduce the mutagenicity of the alkylated polynuclear aromatic containing refinery stream to a level less than the initial mutagenicity index value.

It is, therefore, an object of this invention to provide a process for reducing the relative mutagenicity of a polynuclear aromatic containing material.

It is a further object of this invention to provide a process for reducing the mutagenicity of a polynuclear aromatic containing refinery stream which may be integrated with known downstream converting processes to produce petroleum products of reduced mutagenic tendencies.

It is another object of this invention to provide a process for reducing the mutagenicity of a polynuclear aromatic containing material which is cost effective.

It is a yet further object of this invention to provide a process for reducing the mutagenicity of a polynuclear aromatic containing material which may be conducted on a broad range of PNA-containing feedstocks.

Other objects, aspects and the several advantages of the present invention will become apparent to those skilled in the art upon a reading of the specification and the claims appended thereto.

DETAILED DESCRIPTION OF THE INVENTION

The present invention is predicated on the discovery that a mutagenically active petroleum-based material containing polynuclear aromatic compounds can be made less mutagenic through alkylation. As is well known to those skilled in the art, alkylation is the addition or insertion of an alkyl group into a molecule. There are several types of alkylation reactions. Substitution by an alkyl group can result from attack on an aromatic hydrocarbon by a cation (carbocation), a neutral fragment (free radical), or an anion (carbanion). For each of the several types of alkylation reactions, a particular set of requirements exist, such as heat of reaction, rate of reaction, equilibrium conditions, free energy change, catalyst, equipment and the like.

In the practice of the present invention, the alkylation of aromatic hydrocarbons, including PNA-containing hydrocarbon mixtures, can be carried out using olefins, alcohols, halides, ethers, or any olefin-producing reagent, although, for practical reasons, olefins are generally preferred. The interaction of an olefin with an aromatic hydrocarbon in the presence of a suitable acid catalyst is a preferred means of alkylation. This type of process is an example of electrophilic substitution. The attacking species is a carbocation, formed from the olefin by addition of a proton from a protonic acid, such as sulfuric acid, hydrogen fluoride or phosphoric acid, by a Friedel-Crafts type of catalyst, including aluminum chloride and boron fluoride, or by an oxide catalyst, such as a silica-alumina or zeolite catalyst.

The reaction may be represented as follows:

$$R_2C{=}CR_2 + HX \rightleftharpoons (R_2C{-}\underset{\underset{H}{|}}{}CR_2^{+})X^{-}$$

The X represents an anion, such as $SO_4H^-$, $AlCl_4^-$. The resulting carbocation, represented below as $R^+$, an electron-deficient species, adds to an electron-rich locale of the aromatic ring. The intermediate formed, splits off a proton to give the alkylated aromatic and a regenerated proton.

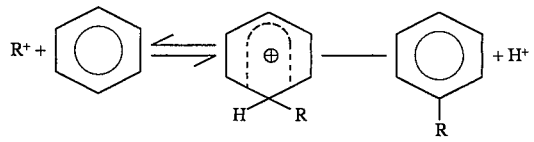

In selecting a suitable alkylation process for use in the practice of the present invention, the overall reaction can be considered as composed of two steps: The first step, formation of the carbocation from the olefin, is controlled by the nature of the specific olefin and the nature of the catalyst, including its activity. As is known to those skilled in the art, ethylene is the most difficult of the lower olefins to bring into reaction, with catalysts such as promoted aluminum chloride and elevated temperature used in such cases. Catalysts such as sulfuric acid and hydrogen fluoride are generally not suitable. The lower olefins containing a tertiary carbon atom, such as isobutylene, can readily be brought into the alkylation reaction, but as the molecular weight increases to octenes and higher, this readiness for alkylation diminishes, with side reactions often dominating. In the second step, the carbocation preferentially attacks those positions on the aromatic nucleus where electrons are most available. The presence of a substituent on the ring can alter this electron availability by two methods, involving an inductive mechanism and a conjugative mechanism. For this reason, the methyl group in toluene favors electrophilic substitution; a chlorine substituent makes substitution more difficult; a nitro group practically excludes substitution by an alkyl group.

As indicated above, catalysts suitable for use in the ring alkylation of aromatic hydrocarbons consist of three categories of acids: (a) protonic acids, (b) Friedel-Crafts catalysts, and (c) oxide catalysts.

Concerning the activity of protonic acid catalysts, it is known to decrease in the following order:

$$HF>H_2SO_4>H_3PO_4>C_2H_5SO_3H.$$

As may be appreciated, however, the choice of the catalyst depends not only on its activity, but on various other considerations. Commercially, phosphoric acid or its modification, silicophosphoric (solid phosphoric acid) is used commercially for the reaction of propene with benzene to form isopropylbenzene. Silicophosphoric acid is also known to catalyze the vapor-phase ethylation of benzene to form ethylbenzene, while reaction of higher alkenes with this catalyst is not recommended because of side reactions, such as skeletal isomerization, which accompany alkylation.

Sulfuric acid does not catalyze the ethylation of benzene, and it is not satisfactory for the reaction of propene with benzene to form isopropylbenzene. Sulfuric acid is, however, an effective catalyst for the alkylation of benzene with higher alkenes. Because of the sulfonating and oxidizing properties of sulfuric acid, alkylations in the presence of this catalyst are carried out at temperatures below 25° C. as compared with 60°–350° C. in the alkylation reactions catalyzed by silicophosphoric acid. Hydrogen fluoride is known to be an efficient catalyst for the alkylation of butenes and higher alkenes with benzene. The control of temperature is less critical than with sulfuric acid, and the catalyst is readily recoverable.

Concerning the activity of typical Friedel-Crafts catalysts, it is known to decrease in the following order:

$$AlBr_3>AlCl_3>GaBr_3>GaCl_3>FeCl_3,\ SbCl_5>ZrCl_4>BF_3>ZnCl_2>Bicl_3.$$

Completely anhydrous metal halides are known to be inactive as catalysts for the alkylation of aromatic hydrocarbons and require a co-catalyst. The addition of HCl or HBr, alkyl halide, or small amounts of alcohol or water activates the metal halides. The function of hydrogen halide is to react with the alkenes to produce alkyl halides, which, in the presence of the metal halides, can generate the activated alkyl complex.

The oxide catalysts envisioned for use in the practice of the present invention are heterogeneous catalysts which have a solid structure, such as the crystalline metallosilicate catalysts. Included among the crystalline materials are the zeolites and clays as well as amorphous silica/alumina materials which have acidic functionality. As is known to those skilled in the art, silica-alumina catalysts have been used for the alkylation of benzene with ethylene and propene. A number of crystalline aluminum silicates (zeolites) have been used for the alkylation of benzene and other aromatic hydrocarbons and hydrocarbon mixtures.

The porous crystalline materials known as zeolites are ordered, porous crystalline metallosilicates, usually aluminosilicates, which can best be described as rigid three-dimensional framework structures of silica and Periodic Table Group IIIA element oxides such as alumina in which the tetrahedra are cross-linked through sharing of oxygen atoms. Zeolites, both the synthetic and naturally occurring crystalline aluminosilicates have the general structural formula:

$$M_{2/n}O\cdot Al_2O_3\cdot ySiO_2\cdot zH_2O$$

where m is a cation, n is its valence, y is the moles of silica and z is the moles of water. In the synthetic zeolites both aluminum and/or silicon can be replaced either entirely or partially by other metals, e.g. germanium, iron, chromium, gallium, and the like, using known cation exchange techniques. Representative examples of the contemplated synthetic crystalline silicate zeolites include the large pore Y-type zeolites such as USY, REY, and another large pore crystalline silicate known as zeolite Beta, which is most thoroughly described in U.S. Pat. Nos. 3,308,069 and Re. 28,341 which are herein incorporated by reference in their entireties. Other catalysts which are contemplated are characterized as the medium pore catalysts. There are other synthetic zeolites which have been synthesized which may be useful in the instant process. These zeolites can be characterized by their unique x-ray powder diffraction data. The following Table sets forth a mere few representative examples of zeolite catalysts which are believed suitable and reference to the corresponding patents which describe them:

TABLE A

| Zeolite | U.S. Pat. No. | Zeolite | U.S. Pat. No. |
|---|---|---|---|
| MCM-2 | 4,647,442 | ZSM-25 | 4,247,416 |
| MCM-14 | 4,619,818 | ZSM-34 | 4,086,186 |
| Y | 3,130,007 | ZSM-38 | 4,046,859 |
| ZSM-4 | 4,021,447 | ZSM-39 | 4,287,166 |
| ZSM-5 | 3,702,886 | ZSM-43 | 4,247,728 |
| ZSM-11 | 3,709,979 | ZSM-45 | 4,495,303 |
| ZSM-12 | 3,832,449; 4,482,531 | ZSM-48 | 4,397,827 |
| ZSM-18 | 3,950,496 | ZSM-50 | 4,640,829 |
| ZSM-20 | 3,972,983 | ZSM-51 | 4,568,654 |
| ZSM-21 | 4,046,859 | ZSM-58 | 4,698,217 |
| Beta | 3,308,069; RE.28,341 | | |
| x | 3,058,805 | | |
| Mordenite | 3,996,337 | | |

A particularly suitable zeolite catalyst used in the process of the invention is a porous crystalline metallosilicate designated as MCM-22. The catalyst is described in more complete detail in U.S. Pat. No. 4,954,325, the entire contents of which are incorporated by reference and reference should be made thereto for a description of the method of synthesizing the MCM-22 zeolite and the preferred method of its synthesis. Briefly; however, MCM-22 has a composition which has the following molar ranges:

$$X_2O_3:(n)YO_2$$

where X is a trivalent element, such as aluminum, boron, iron and/or gallium. Preferably X is aluminum. Y is a tetravalent element such as silicon and/or germanium preferably silicon and n is at least about 10, usually from about 10 to 150, more usually from about 10 to about 60, and even more usually from about 20 to about 40. In the as-synthesized form, zeolite MCM-22 in its anhydrous state and in terms of moles of oxides per n moles of $YO_2$, has the following formula $$(0.005\text{–}0.1)Na_2O:(1\text{–}4)R:X_2O_3:nYO_2$$

where R is an organic component. The Na and R components are associated with the zeolite as a result of their presence during crystallization and are easily removed by known post-crystallization methods.

Representative examples of suitable naturally occurring zeolites include faujasite, mordenite, zeolites of the chabazite-type such as erionite, offretite, gmelinite and ferrierite.

Clay catalysts, another class of crystalline silicates, are hydrated aluminum silicates generalized by the following structural formula:

$$Al_2O_3SiO_2\cdot xH_2O$$

Typical examples of suitable clays, which are acid-treated to increase their activity, are made from halloysites, kaolinites and bentonites composed of montmorillonite. These catalysts can be synthesized by known methods and are commercially available.

The catalysts suitable for use in this invention can be incorporated with a variety of known materials which are known to enhance the zeolite's resistance to temperature and reaction conditions of the conversion process of interest. These materials include other catalytically active materials such as other natural or synthetic crystalline silicates or inactive materials such as clays which are known to improve the crush strength of the catalyst or which act as binders for the catalyst. The catalyst can also be composited with a porous matrix. The porous matrix materials are well known in the art and are those which are advantageously used to facilitate extrusion of the catalyst.

The catalyst can be treated by steam stabilization techniques. These are known processes which are described in U.S. Pat. Nos. 4,663,492; 4,594,146; 4,522,929 and 4,429,176 the disclosures of which are incorporated herein by reference in their entireties.

The PNA-containing feedstock is subjected to an alkylation reaction in the presence of an alkylating agent which, as indicated above, may be any olefin, alcohol, halide, ether, or any olefin-producing reagent. Included is any aliphatic hydrocarbon having at least one olefinic double bond capable of reacting with the PNA's of the feedstock. Suitable alkylating agents include long chain or short chain olefins. The term "long chain" olefin means that the olefin contains about 8 or more carbon atoms, more specifically 8 to 24 carbon atoms. The term "short chain" olefin is used to mean that the hydrocarbon contains less than 8 carbon atoms, more specifically less than about 5 carbon atoms. In general, the olefins contemplated herein contain at least one carbon-carbon double bond and can be a 1-olefin or a 2-olefin. The olefins can be straight chain or branched.

In the instant process, either short or long chain olefins may be preferred depending upon the final properties sought to be achieved by the alkylation product. For example, long chain olefins, that is, olefins having more than 8 carbon atoms are preferred in order to produce a functional fluid fraction having a higher viscosity index (VI). The higher VI gives the functional fluid lubricating oil qualities which the longer chain alkyl group supplies. Long chain olefin sources can be derived from light olefins ($C_2^=$ to $C_5^=$) via olefin dimerization and oligomerization reactions.

Olefinic hydrocarbon fractions can be used quite effectively as alkylating agents. Olefinic hydrocarbon fractions contemplated include olefin streams from the FCC unit, e.g., light olefins ($C_3$–$C_4$), and FCC gasoline fractions. Preferred olefinic feedstocks also include coker products such as coker naphtha, coker gas oil, distillate gasoline and kerosene.

Concerning the feedstocks which can be benefitted by the present invention, as disclosed in U.S. Pat. No. 5,034,119, polynuclear aromatic compounds (PNA's) of 3–7 rings have been found to be responsible for the mutagenic activity of certain petroleum-based products and, as such, those materials having significant levels of such PNA's are among those feedstocks. The biologically active PNA's having 3–7 rings are generally considered to fall in the boiling range of 640° to 1000° F.

The Modified Ames Assay procedure disclosed in U.S. Pat. No. 4,499,187 is particularly preferred for use in determining the relative mutagenicity of a material as it can rapidly and reliably determine the potential carcinogenic activity of hydrocarbon mixtures of petroleum origin. Mutagenicity index (MI), as disclosed in U.S. Pat. No. 4,499,187, is a ranking for relative mutagenic potency. MI is the slope of the dose response curve for mutagenesis. As indicated above, non-carcinogenic materials are known to exhibit MI's of less than or equal to about 1.0, with materials having no mutagenic activity at all exhibiting MI's equal to about 0.0.

The present invention is further illustrated by the following non-limiting examples.

EXAMPLE 1

This example demonstrates that the mutagenicity of benzo [a]pyrene (BaP) can be reduced by $C_4$ Friedel-Crafts alkylation.

Four 100 mg aliquots of BaP were placed in separate 20× 150 mm screw-top tubes and dissolved in 5 ml carbon disulfide ($CS_2$). To each of these was added 1.0 ml of tert-butylchloride, which was thoroughly mixed. Ten to 15 mg of aluminum chloride ($AlCl_3$) were then added to each tube and mixed gently at room temperature while the reaction progressed. The reaction in the first tube was allowed to progress for one hour, the second tube for two hours, the third tube for three hours and the fourth tube for four hours. The samples were analyzed using a gas chromatograph (GC) and a flame ionization detector (FID). Table 1, below, presents the product distribution and mutagenicity index for the alkylation reaction products.

TABLE 1

PRODUCT DISTRIBUTION AND MUTAGENICITY INDEX VS. REACTION TIME

| Reaction Time, hr. | Mutagenicity Index | % BaP | Mono-$C_4$ BaP | % Di-$C_4$ BaP |
|---|---|---|---|---|
| 0 | 28.0 | 100 | — | — |
| 1 | 3.5 | 22 | 78 | 0 |
| 2 | N/A | <1 | 52 | 47 |
| 3 | 0.6 | 0 | 26 | 74 |
| 4 | 0.2 | 0 | 17 | 83 |

As may be seen, the mutagenicity index of a highly mutagenic compound, benzo[a] pyrene, can be substantially reduced through a $C_4$ Friedel-Crafts alkylation.

EXAMPLE 2

This example demonstrates that a $C_3$ Friedel-Crafts alkylation will also significantly reduce the mutagenicity of a furfural extract having characteristics similar to that of the material employed in Example 2. The furfural extract of this example also contained a significant level of mutagenic PNA's.

A 100 mg sample of the furfural extract was placed in a 20×150 mm screw-top tube and dissolved in 5 ml carbon disulfide ($CS_2$). To this was added 1.0 ml of isopropyl chloride, which was thoroughly mixed. Fifteen to 25 mg of aluminum chloride ($AlCl_3$) was then added and vigorously mixed. The tube was then agitated at room temperature for 23 hours while the reaction progressed. The sample was analyzed using a gas chromatograph (GC) and a flame ionization detector (FID) to assess the extent of the reaction. The mutagenicity index of the furfural extract before alkylation was 9.1, while the alkylated product had a mutagenicity index of 5.3.

Once again, the mutagenicity index of a significantly mutagenic PNA-containing sample was substantially reduced through Friedel-Crafts alkylation.

EXAMPLE 3

This example demonstrates the benefit in mutagenicity reduction achieved via $C_4$ Friedel-Crafts alkylation for a furfural extract of a certain lubricant refinery stream. The furfural extract contained a significant level of mutagenic PNA's.

A 100 mg sample of the furfural extract was placed in a 20×150 mm screw-top tubes and dissolved in 5 ml carbon disulfide ($CS_2$). To this was added 1.0 ml of tert-butylchloride, which was thoroughly mixed. Fifteen to 25 mg of aluminum chloride ($AlCl_3$) was then added. The tubes were agitated at room temperature for 6 hours while the reaction progressed. The sample was analyzed using a gas chromatograph (GC) and a flame ionization detector (FID) to assess the extent of the reaction. The mutagenicity index of the furfural extract before alkylation was 10.4, while the alkylated product had a mutagenicity index of <1.0.

Again, the mutagenicity index of a significantly mutagenic sample, this time a furfural extract, was substantially reduced through $C_4$ Friedel-Crafts alkylation.

EXAMPLE 4

This example demonstrates the benefit in mutagenicity reduction achieved via $C_4$ Friedel-Crafts alkylation for a furfural extract of a certain propane deasphalted vacuum residuum, commonly referred to as bright stock extract (BSE). The BSE will usually contain a significant level of mutagenic PNA's.

A one-gram sample of the BSEwas placed in a 20×150 mm screw-top tube and dissolved in 5 ml carbon disulfide ($CS_2$). To this was added 1.0 ml of tert-butylchloride, which was thoroughly mixed. Fifteen to 25 mg of aluminum chloride ($AlCl_3$) was then added. The tube was agitated at room temperature for 48 hours while the reaction progressed. The mutagenicity index of the BSE prior to alkylation was 1.7, while the alkylated product had a mutagenicity index of 0.2.

In this same experiment, one gram of the BSE was extracted with dimethylsulfoxide (DMSO) and the DMSO extract back-extracted with water and cyclohexane to isolate a PNA-enriched fraction of the BSE. A 50 mg aliquot of the extraction residue was alkylated under the same conditions as the BSE described above. The mutagenicity index of the BSE extract prior to alkylation was 32, while the alkylated product had a mutagenicity index of 0.2.

EXAMPLE 5

This example demonstrates that an alkylation reaction employing a silica supported $AlCl_2$ catalyst and an olefin significantly reduces the mutagenicity of BaP.

A 50 mg sample of BaP was placed in a 5 ml screw-top reaction vial and dissolved in 3 ml of carbon disulfide ($CS_2$). Approximately 260 mg of silica supported aluminum dichloride ($SiO_2$–$AlCl_2$) was added to the vial and the vial cooled in a dry ice-acetone bath to permit the addition of 45 microliters (2 mole equivalents) of 2-pentene. The reaction mixture was heated in an oil bath for 0.5 hours at 115° C. An additional 45 μl of 2-pentene was added after cooling and the reaction allowed to proceed for an additional 4 hours.

The sample was analyzed using a gas chromatograph (GC) and a flame ionization detector (FID) to assess the extent of the reaction. The GC/FID analysis indicated that approximately 98% of the starting BaP had been converted to a mixture of numerous mono-, di-, and tri-$C_5$ isomers of BaP. The mutagenicity index of the $C_5$-alkylated BaP reaction product was 0.4.

EXAMPLE 6

This example demonstrated that an alkylation reaction which employs an MCM-22 zeolite catalyst and an olefin, has the potential to alkylate BaP as per Examples 1 and 5 above and thus significantly reduce its mutagenic activity.

An MCM-22 catalyst was made in accordance with the process described in Example 11 of U.S. Pat. No. 4,954,325. Two 50 mg aliquots of BaP were placed in separate 5 ml screw-top reaction vessels and dissolved in 3 ml of carbon-disulfide ($CS_2$). Approximately 100 mg of MCM-22 catalyst was added to each of the vials and the vials cooled in a dry ice-acetone bath prior to the addition of approximately 10 mole equivalents of isobutylene. The reaction in one vial was allowed to proceed for 4 hours at 108° C. The reaction in the other vial was allowed to proceed for 0.5 hours at 175° C.

The samples were analyzed by GC/FID and the chromatograms compared to the chromatograms from Example 1. The product profile of the 108° C./4 hour reaction showed 74% conversion of BaP to the same mono- and di-$C_4$ alkylated products observed in Example 1 (see Table 1). The product profile of the 175° C./0.5 hour reaction showed 73% conversion of BaP to the same mono- and di-$C_4$ alkylated products observed in Example 1 (see Table 1). Again, by comparison with Example 1 the reaction in Table 1 with 78% conversion to mono- and di-$C_4$ alkylated BaP products has an MI-value of 3.5, significantly reduced from the BaP MI-value of 28.

Although the present invention has been described with preferred embodiments, it is to be understood that modifications and variations may be utilized without departing from the spirit and scope of this invention, as those skilled in the art will readily understand. Such modifications and variations are considered to be within the purview and scope of the appended claims.

What is claimed is:

1. A process for reducing the mutagenicity of a hydrocarbonaceous refinery stream containing polynuclear aromatic compounds having three to seven fused aromatic rings, the stream having an initial mutagenicity index value greater than about 0.0, comprising the step of:

(a) contacting the polynuclear aromatic containing refinery stream in the presence of an alkylating agent having from three to five carbon atoms with an acid catalyst under alkylation conditions sufficient to monoalkylate or dialkylate the polynuclear aromatic compounds of the refinery stream with a branched chain alkyl group of three to five carbon atoms to reduce the mutagenicity of the alkylated polynuclear aromatic containing refinery stream to a level less than the initial mutagenicity index value.

2. The process as described in claim 1, wherein the alkylating agent is selected from the group consisting of olefins, alcohols, halides and ethers.

3. The process as described in claim 2, wherein the alkylating agent is an olefinic hydrocarbon composition.

4. The process as described in claim 3, wherein the alkylating agent is is an iso-propyl or tertiary-butyl compound.

5. The process as described in claim 1, wherein the catalyst is selected form the group consisting of protonic acids, Friedel-Crafts catalysts, and oxide catalysts.

6. The process as described in claim 5, wherein the oxide catalyst is a crystalline metallosilicate catalyst.

7. The process as described in claim 6, wherein the crystalline metallosilicate catalyst is a natural or synthetic zeolite or an acid-treated clay catalyst.

8. The process as described in claim 1, further comprising the step of:

(b) separating the unreacted fraction of the refinery stream from the alkylated fraction of the refinery stream.

* * * * *